US006554746B1

(12) United States Patent
McConnell et al.

(10) Patent No.: US 6,554,746 B1
(45) Date of Patent: Apr. 29, 2003

(54) INSPIRATORY MUSCLE TRAINING DEVICE WITH VARIABLE LOADING

(76) Inventors: Alison Kay McConnell, 46 Fallowfield Ave., Hall Green, Birmingham, B28 0NL (GB); Michael Peter Caine, 5 Castle Green, Kenilworth, Warwickshire, CV8 1NE (GB); Graham Keith Lacy, 19 Gosberton Road, Balham, London, SW12 8LE (GB)

( * ) Notice: Subject to any disclaimer, the term of this patent is extended or adjusted under 35 U.S.C. 154(b) by 0 days.

(21) Appl. No.: 09/830,006

(22) PCT Filed: Oct. 21, 1999

(86) PCT No.: PCT/EP99/08146

§ 371 (c)(1),
(2), (4) Date: Jun. 11, 2001

(87) PCT Pub. No.: WO00/24476

PCT Pub. Date: May 4, 2000

(30) Foreign Application Priority Data

Oct. 23, 1998 (EP) ..... 98308706

(51) Int. Cl.[7] ..... A63B 23/18
(52) U.S. Cl. ..... 482/13; 601/41
(58) Field of Search ..... 482/13, 148; 601/41–43; 128/29, 191, 2.08

(56) References Cited

U.S. PATENT DOCUMENTS

| | | | | |
|---|---|---|---|---|
| 793,177 | A | * | 6/1905 | Cady ..... 128/2.08 |
| 1,988,221 | A | * | 1/1935 | Soskin ..... 128/191 |
| 2,121,311 | A | * | 6/1938 | Anderson et al. ..... 128/29 |
| 3,319,624 | A | * | 5/1967 | Arp et al. ..... 128/2.08 |
| 3,395,699 | A | * | 8/1968 | Beasley ..... 128/2.08 |
| 3,467,078 | A | * | 9/1969 | Bird et al. ..... 128/2.08 |
| 3,669,097 | A | * | 6/1972 | Fitz ..... 128/2.08 |
| 4,854,574 | A | * | 8/1989 | Larson et al. ..... 272/99 |

OTHER PUBLICATIONS

International Search Report Feb. 9, 2000.

* cited by examiner

*Primary Examiner*—Nicholas D. Lucchesi
*Assistant Examiner*—Lori Baker Amerson
(74) *Attorney, Agent, or Firm*—Ira S. Dorman

(57) ABSTRACT

An inspiratory muscle training device comprises a chamber having an opening for the passage of air to be inhaled and exhaled, and an inlet permitting air to be inhaled to enter the chamber and to pass to the opening. A one-way exhaust valve permits exhaled air entering through the opening to escape from the chamber, and another valve is provided to resist the entry of air to be inhaled into the chamber, the latter valve serving to vary the degree of resistance in dependence upon the volume of air that has passed through the inlet.

15 Claims, 4 Drawing Sheets

INSPIRATORY MUSCLE TRAINING DEVICE WITH VARIABLE LOADING

This invention relates to an inspiratory muscle training device with variable loading.

Inspiratory muscle training devices are well known, for example from UK Patent Specification No. 2 278 545 and U.S. Pat. No. 4,854,574. These known devices each incorporate a chamber having an opening in the form of a mouthpiece for the passage of air to be inhaled and exhaled, an inlet permitting air to be inhaled to enter the chamber and to pass to the opening, a one-way exhaust valve permitting exhaled air entering through the opening to escape from the chamber, and a valve to resist the entry of air to be inhaled into the chamber, which valve is designed to open at a constant threshold pressure. Although the threshold pressure can be varied by the user from breath to breath or session to session, the known devices effectively present a preselected constant load to inspiration. That is, the load is constant in that it is independent of flow and does not vary with time or lung volume.

The mechanical characteristics of the inspiratory muscles dictates that their strength varies according to the degree to which the lungs are inflated. Consequently we have recognised the importance of a load which varies according to lung volume during inspiration.

It is therefore an object of the present invention to provide an inspiratory muscle training device which demonstrates a resistance to inspiration that varies according to lung volume.

According to the present invention there is provided an inspiratory muscle training device with variable loading, which device comprises a chamber having an opening for the passage of air to be inhaled and exhaled, an inlet permitting air to be inhaled to enter the chamber and to pass to the opening, a one-way exhaust valve permitting exhaled air entering through the opening to escape from the chamber, and means to resist the entry of air to be inhaled into the chamber, wherein the means to resist the entry of air includes means to vary the degree of resistance in dependence upon the volume of air that has passed through the inlet.

The resistance may decrease as the volume of air that has passed through the inlet increases.

The means to resist the entry of air into the chamber may comprise a valve provided in the opening, the valve being urged by biasing means to a closed position in such a manner that the pressure differential across the valve required to open the same varies in dependence on the volume of air that has passed through the valve for a given inspiratory cycle.

Means may be provided to vary the initial pressure differential required to open the valve.

The means to vary the pressure differential in dependence upon the volume of air that has passed through the valve may comprise a lever acting between the biasing means and the valve, the lever having a movable fulcrum. The fulcrum may be movable relative to the volume of air that has passed through the valve. Movement of the fulcrum may be relatively slow initially, increasing with the volume of air that has passed through the valve. The fulcrum may be movable by way of a diaphragm, the amount of movement of the diaphragm being in relation to the volume of air that has passed through the valve.

The first-mentioned valve may be mechanically linked to a further valve which passes air at a flow rate proportional to the flow rate of air through the first-mentioned valve. Air passing through the further valve may be employed directly or indirectly to move the diaphragm.

Alternatively, the means to vary the pressure differential in dependence upon the volume of air that has passed through the valve may comprise cam means. The cam means may be movable by a rotary impeller positioned in the path of air entering the chamber.

Means may be provided to vary the rate at which the pressure differential required to open the valve changes, for example by varying the proportion of air flowing through the further valve relative to the volume of air flowing through the first-mentioned valve.

For a better understanding of the present invention and to show more clearly how it may be carried into effect reference will now be made, by way of example, to the accompanying drawings in which.

Throughout the drawings and description the same reference numerals are used to denote the same or similar components.

Figure 1:
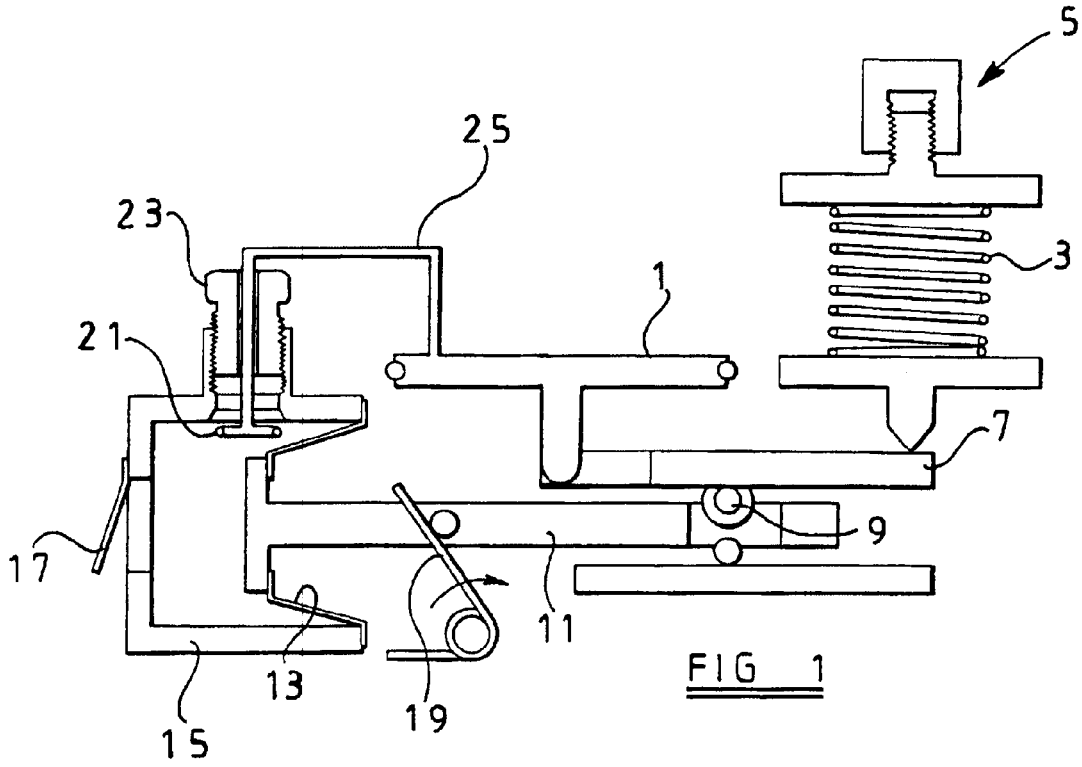
FIG. 1 is a diagrammatic representation of part of one embodiment of an inspiratory muscle training device according to the present invention.

FIG. 1 shows diagrammatically one embodiment of that part of an inspiratory muscle training device which applies variable loading to the inspiratory muscles of the user. FIG. 1 shows a primary valve member 1 which is biased towards a closed position by a compression spring 3. The primary valve is opened at a predetermined variable threshold pressure as a result of inspiration by the user as will be explained in more detail hereinafter.

The initial threshold pressure at which the valve member 1 opens is determined by a threaded adjusting member 5 for increasing and decreasing the closure force and therefore the pressure at which the valve member 1 opens, the greater the degree of compression of the spring 3, the greater the initial threshold pressure.

The spring 3 acts on the valve member 1 by way of a lever 7 which is pivotable about a fulcrum 9. Fulcrum 9 is provided on a rod 11 which is movable in the longitudinal direction of the lever 7 so as to vary the location of the fulcrum 9 along the lever. Thus, when the fulcrum is in a position relatively close to the valve member 1 (for example, generally mid-way along the lever 7 at the commencement of inspiration) the mechanical advantage is such that the compression spring 3 causes the threshold pressure at which the valve opens to be relatively high and when the fulcrum is in a position relatively close to the compression spring 3 the mechanical advantage is such that the compression spring causes the threshold pressure at which the valve opens to be relatively low or even substantially zero, with the threshold pressure varying according to the location of the fulcrum 9 intermediate these positions.

The rod 11 is connected to a diaphragm 13 provided in an evacuable chamber 15. The chamber 15 is also provided with a one-way exhaust valve 17 which allows the diaphragm to be compressed (by means not shown) into the chamber 15 prior to the user taking a breath and for air in the chamber to be exhausted through the valve 17. An initial partial vacuum is therefore created in the chamber 15.

Biasing means 19, such as a torsion spring, acts on the rod 11 to bias the same in a direction such that the fulcrum is in a position relatively close to the compression spring 3 and the mechanical advantage is such that the compression spring 3 causes the threshold pressure at which the valve member 1 opens to be relatively low.

The biasing means 19 alone cannot cause the rod 11 to move against the partial vacuum in the chamber 15. The chamber 15 is additionally provided with a secondary valve 21, the opening area of which is adjustable by way of a threaded adjusting member 23. The secondary valve 21 is mechanically linked (shown diagrammatically at 25) to the primary valve member 1 such that air is allowed to flow through the secondary valve and into the chamber 15 at a rate which is proportional to the flow of air past the valve member 1. Additionally, the closure force of the secondary valve 21 varies according to the closure force of the primary valve member 1. Moreover, the volume of air passing through the secondary valve 21 as a proportion of the volume of air passing the primary valve member 1 can be varied, for example by providing a plurality of openings in a fixed member and in a movable member such that the degree of overlap of the openings in the two members can be varied, such as by relative rotation.

The flow of air into the chamber 15 reduces the effect of the partial vacuum and allows the diaphragm 13 to move and consequently allows the biasing member 19 to move the rod 11, and therefore the diaphragm, to restore the partial vacuum and consequently to move the fulcrum 9 closer to the compression spring 3. The effect of this is to reduce the threshold pressure at which the primary valve member 1 opens from an initial value to a progressively lower value as a function of the volume of air passing through the valve member.

It should be noted that the adjusting member 5 can be used to adjust the initial threshold pressure at which the primary valve member opens, while the adjusting member 23 can be used to adjust the rate at which the fulcrum moves, and thus the rate at which the threshold pressure reduces, in response to the passage of a predetermined volume of air through the primary valve (that is by varying the flow rate through the secondary valve relative to the flow rate through the primary valve).

Figure 3:
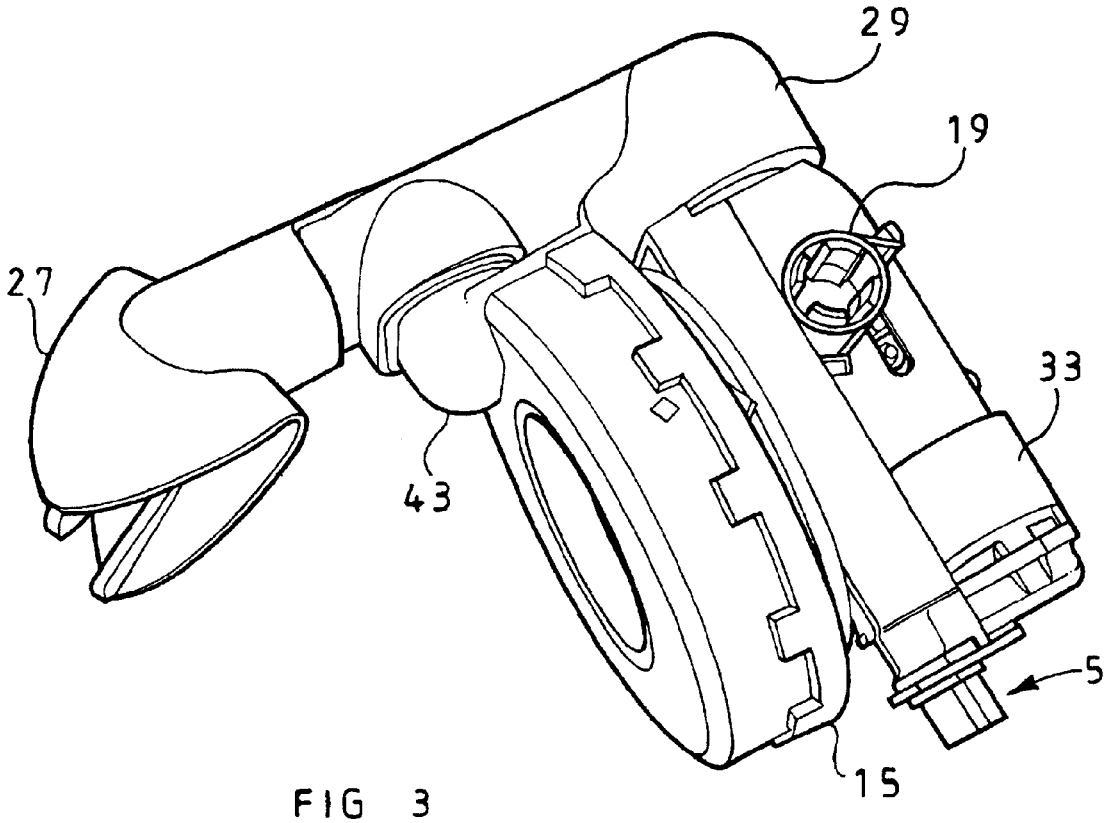
FIG. 3 is a further diagrammatic perspective view of the inspiratory muscle training device shown in FIG. 2.
Figure 2:
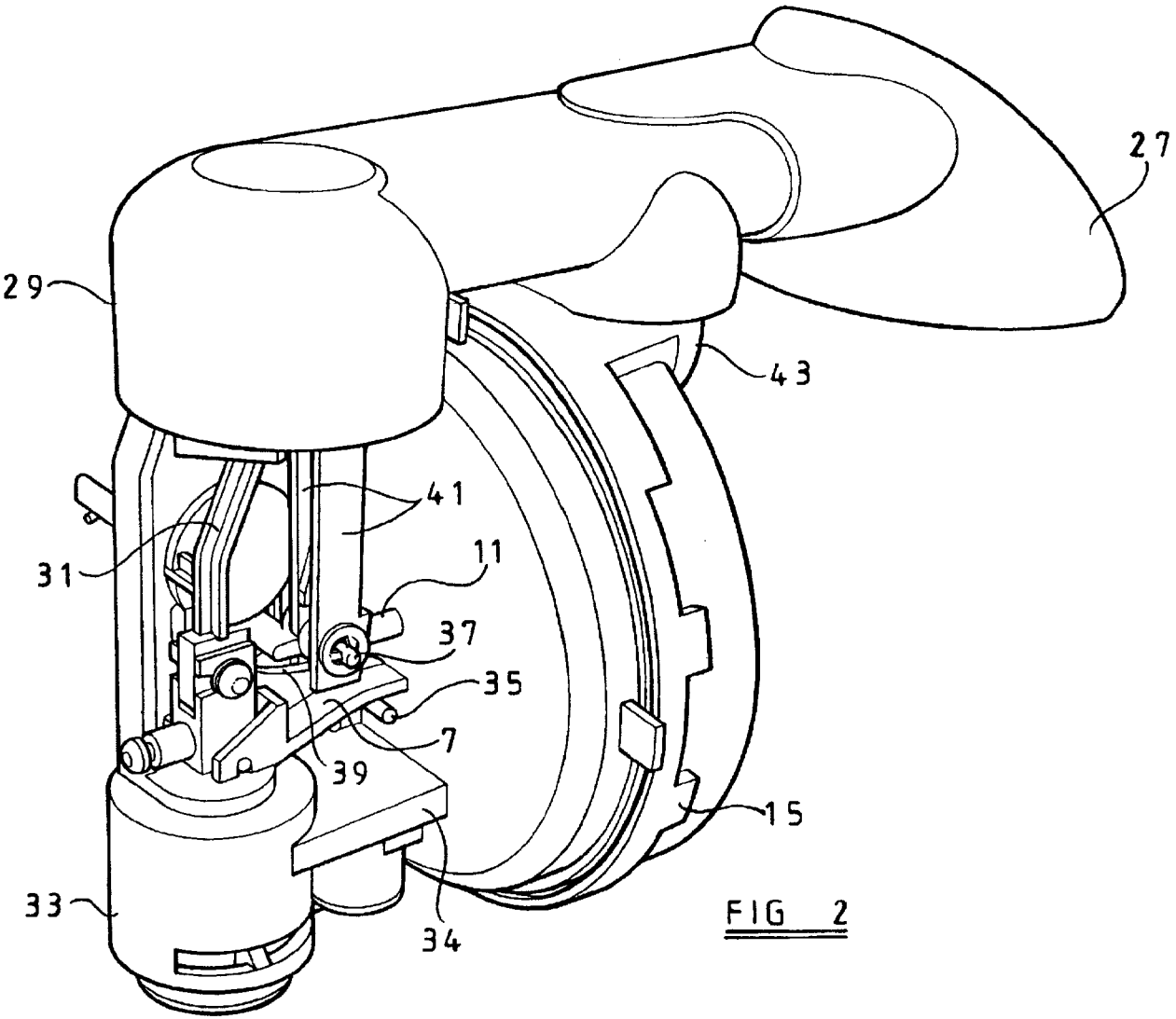
FIG. 2 is a diagrammatic perspective view of another embodiment of an inspiratory muscle training device according to the present invention.

The embodiment shown in FIGS. 2 and 3 has a mouthpiece 27 for drawing air through the primary valve member (not shown) in a valve chamber 29, the valve member being operated by way of a valve stem 31 (FIG. 2). The valve stem is pivotably mounted on lever 7 and is additionally connected to a secondary valve provided with a valve chamber 33. Valve chamber 33 communicates with the interior of the diaphragm chamber 15 by way of a passage 34 to allow air from the secondary valve to flow into the diaphragm chamber. The compression spring also acts on lever 7 by way of a pivotably mounted pin or the like 35 (FIG. 2), part of the threaded adjusting member 5 being shown in FIG. 3.

Rod 11 is shown in FIG. 2 and extends out of the chamber 15 by way of a seal which is not shown in detail and the free end of the rod acts on a pivot pin 37 by way of a pair of parallel levers 41. The pivot pin 37 forms the fulcrum either directly or by way of a roller provided on the pivot pin 37 and engages against a contoured surface 39 formed on the lever 7. The pivot pin 37 is mounted towards the end of the pair of parallel levers 41 which are pivotably mounted at the other ends thereof (not shown) for receiving the free end of the rod 11. Biasing means 19 in the form of a torsion spring is shown in FIG. 3, the torsion spring conveniently being positioned around an exhaust port for the diaphragm chamber.

Thus as air enters the diaphragm chamber from the secondary valve the rod 11 (which in the embodiment of FIGS. 2 and 3 passes through the wall of the diaphragm chamber and therefore operates in the opposite sense to that shown in FIG. 1) is biased to move to the right as shown in FIG. 3 and moves the fulcrum progressively towards the point at which the compression spring acts on the lever 7 thereby reducing the threshold pressure at which the primary valve opens.

As an alternative to direct movement of the fulcrum by means of a rod, the fulcrum could be mounted on a lever which rotates about a remote centre.

The manner in which the opening pressure of the primary valve varies is additionally influenced by the contour provided on the lever 7, the contour determining the degree of compression of the spring in a manner which can be varied according to need as will readily be understood by the skilled person.

It is necessary to reset the position of the diaphragm and of the rod 11 each time the user exhales in order that the initial threshold pressure for the primary valve should be restored. This is accomplished by providing a duct 43 in which a one-way valve is provided, the valve opening when the user exhales in order to allow exhaled air to escape.

As will be explained in more detail hereinafter, exhaled air is used to reset the diaphragm and to urge the rod 11 towards the left as shown in FIG. 2 and to restore the partial vacuum in the chamber by expelling air through the one-way exhaust valve.

Figure 4:
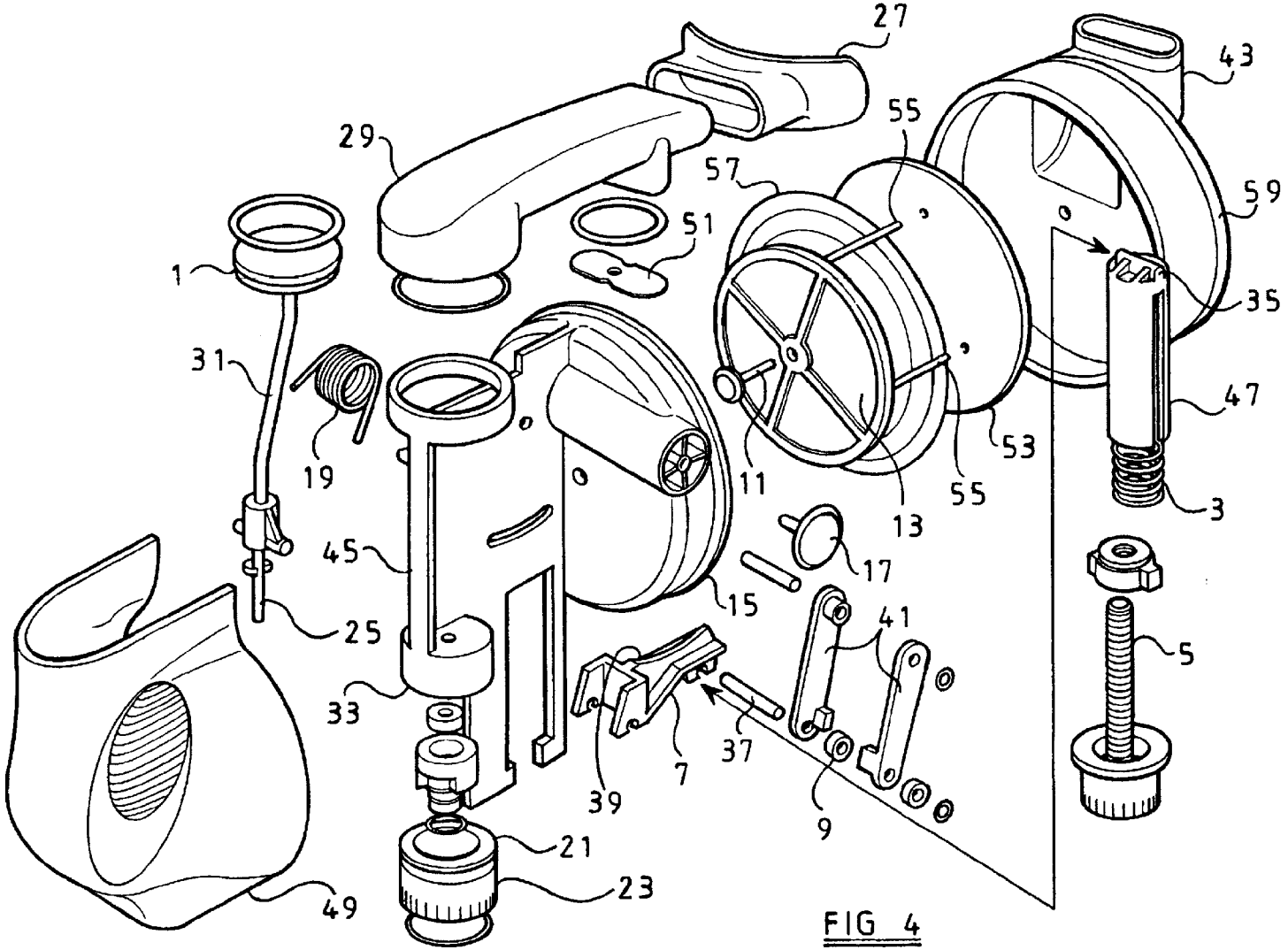
FIG. 4 is an exploded perspective view of a further embodiment of an inspiratory muscle training device according to the present invention.

The embodiment shown in FIG. 4 differs from that shown in FIGS. 2 and 3 in that the exhaust port for the diaphragm chamber 15 is on the opposite side of the chamber. FIG. 4 shows a number of aspects of the device according to the invention in more detail. As shown in FIG. 4, the diaphragm chamber 15 forms part of a chassis 45 for mounting the remaining components of the device, the adjusting member 5, for example, being received in the chassis in a manner which permits the application of a variable pressure on the underside (as shown in FIG. 4) of the lever 7 an arrow showing the actual location of a pivot member 35 attached to a sleeve 47 for the spring 3. The valve stem 31, lever 7 and components for adjusting the fulcrum are concealed in use by a cover 49.

FIG. 4 shows more clearly how the diaphragm 13 may be reset. Exhaled air passes through a one-way valve 51 to the duct 43 and encounters a baffle 53 which is slidably mounted on pins 55 provided on a support 57 for the diaphragm. Initially the baffle 53 is a relatively close fit to the walls of a closure member 59 and is therefore urged by the exhaled air towards the diaphragm 13 and, in turn, urges the diaphragm and the rod 11 to the left as shown in FIG. 4. This movement of the diaphragm compresses the air in the chamber 15 and urges the same through the one-way exhaust valve 17 so as to restore the partial vacuum within the chamber. Further movement of the baffle 53 reveals openings in the closure member 59 which allow the exhaled air to escape to atmosphere.

Figure 5:
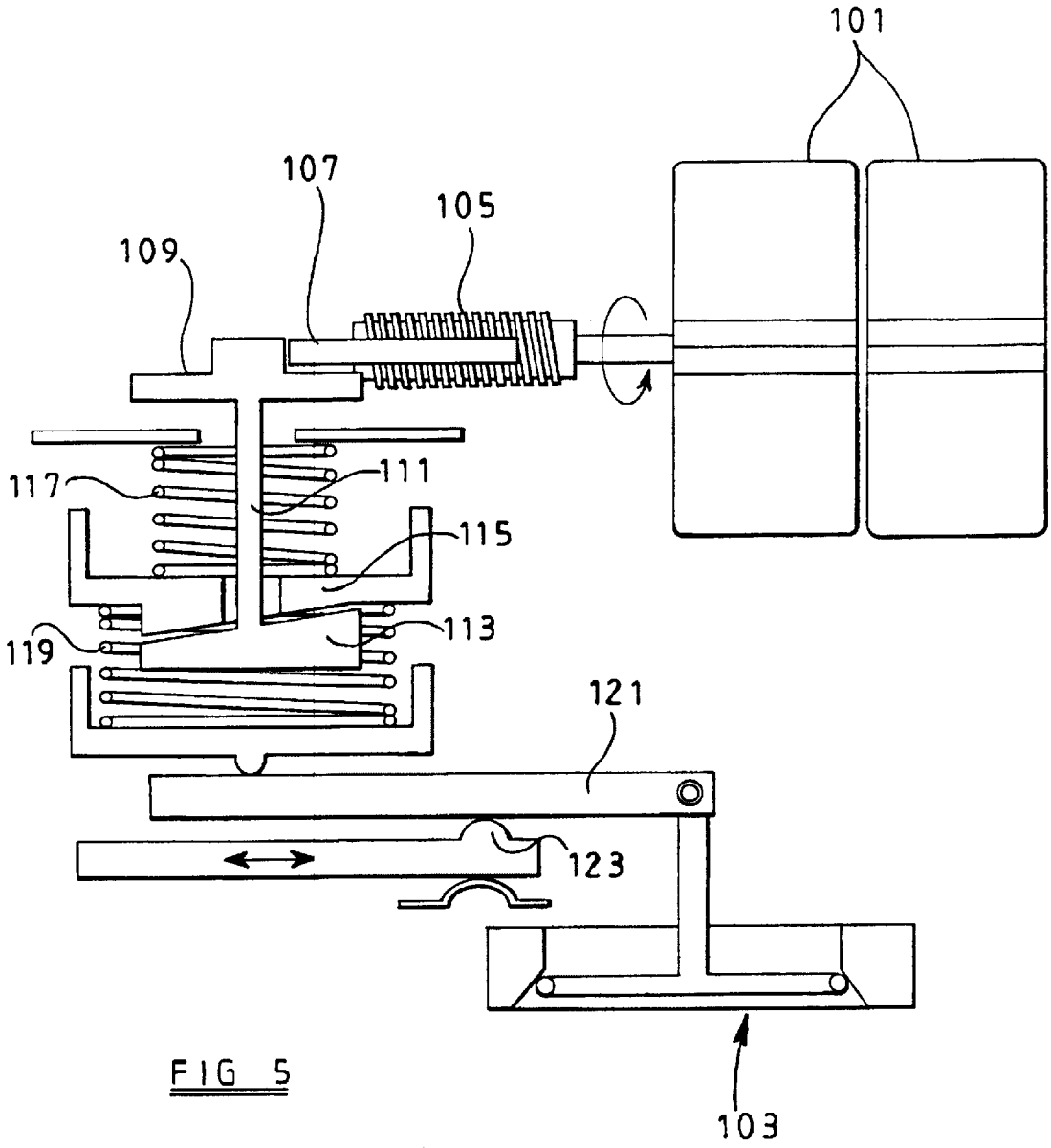
FIG. 5 is a diagrammatic illustration of the manner of operation of a further embodiment of part of an inspiratory muscle training device according to the present invention.

FIG. 5 is a partial illustration showing the manner of operation of a further embodiment of an inspiratory muscle training device according to the present invention. As shown in FIG. 5, a paddle wheel impeller 101 is positioned in an inlet (not shown) of the device such that the amount of rotation of the impeller is dependent on the volume of air which passes through a downstream valve 103.

Rotation of the impeller 101 is passed through reduction gearing including, for example, a worm gear 105 and toothed gears 107, 109. Out put from the reduction gearing is by way of a rotating shaft 111 which rotates a face cam 113 relative to a further non-rotatable face cam 115. Face cam 115 is biased towards face can 113 by means of a coil spring 117 or the like, while biasing means such as coil spring 119 acts between the face cam 115 and a pivotable lever mechanism 121 to determine a threshold pressure at which the valve 103 opens in dependence on the degree of rotation of the cams 113, 115.

The initial threshold pressure can be adjusted as indicated by arrows by moving a fulcrum point 123 about which the lever mechanism 121 pivots.

The impeller 101 is arranged such that a variable proportion of the air passing through the valve 103 by-passes the impeller and therefore does not give rise to rotation thereof. The amount of air by-passing the impeller can be adjusted for each user by simple experiments such that the cam 113 rotates substantially 360 degrees for each inspiratory (inhalation) cycle.

The inspiratory muscle training device according to the present invention permits ambulatory use. That is, it enables the user to use the device while exercising.

For athletes this enables the user to take advantage of the principle of "training specificity" according to which the more faithfully the training situation mimics the competitive situation the greater the improvements in performance.

Thus the inspiratory muscle training device according to the present invention imposes a load which varies according to lung volume and hence muscle strength to provide a resistance that is a constant fraction of maximal strength during inspiration.

The inspiratory muscle training device according to the present invention also has medical applications. The ability to control the variable pressure/volume loading profile achieved with variable pressure decay and initial opening pressure is more appropriate for patients with lung disease than the current threshold devices. This is primarily due to the fact that fixed loading is unsympathetic to the diverse and complex nature of breathing patterns observed in such patients.

It should also be noted the inspiratory muscle training device is not restricted to use by humans and can be used for training the inspiratory muscles of other animals, particularly horses and dogs.

What is claimed is:

1. An inspiratory muscle training device comprising: a chamber having an opening for the passage of air to be inhaled and exhaled, an inlet permitting air to be inhaled to enter the chamber and to pass to the opening, a one-way exhaust valve permitting exhaled air entering through the opening to escape from the chamber, and means to resist the entry of air to be inhaled into the chamber, wherein the means to resist the entry of air includes means to vary the degree of resistance in dependence upon the volume of air that has passed through the inlet during a single inspiratory cycle.

2. An inspiratory muscle training device according to claim 1, wherein the means to vary the degree of resistance is adapted to decrease the resistance to the entry of air as the volume of air that has passed through the inlet during a single inspiratory cycle increases.

3. An inspiratory muscle training device according to claim 1, wherein the means to resist the entry of air into the chamber comprises a valve provided in the opening, the valve being urged by biasing means to a closed position in such a manner that the pressure differential across the valve required to open the same varies in dependence on the volume of air that has passed through the valve during a single inspiratory cycle.

4. An inspiratory muscle training device according to claim 3, wherein means is provided to vary the initial pressure differential required to open the valve.

5. An inspiratory muscle training device according to claim 3, wherein the means to vary the pressure differential in dependence upon the volume of air that has passed through the valve comprises a lever acting between the biasing means and the valve, the lever having a fulcrum which is movable in a lengthwise direction of the lever.

6. An inspiratory muscle training device according to claim 5, wherein the fulcrum is movable in the lengthwise direction of the lever relative to the volume of air that has passed through the valve during a single inspiratory cycle.

7. An inspiratory muscle training device according to claim 5, wherein means is provided to move the fulcrum at a rate which increases with the volume of air that has passed through the valve during a single inspiratory cycle.

8. An inspiratory muscle training device according to claim 5, wherein the fulcrum is movable in the lengthwise direction of the lever by way of a diaphragm, the amount of movement of the diaphragm being in relation to the volume of air that has passed through the valve during a single inspiratory cycle.

9. An inspiratory muscle training device according to claim 1, wherein the means to resist the entry of air is mechanically linked to a valve which passes air at a flow rate proportional to the flow rate of air through the means to resist the entry of air.

10. An inspiratory muscle training device according to claim 8, wherein the means to resist the entry of air is mechanically linked to a valve which passes air at a flow rate proportional to the flow rate of air through the means to resist the entry of air, air passing through the valve being employed directly or indirectly to move the diaphragm.

11. An inspiratory muscle training device according to claim 3, wherein the means to vary the pressure differential in dependence upon the volume of air that has passed through the valve comprises cam means.

12. An inspiratory muscle training device according to claim 11, wherein the cam means is movable by a rotary impeller positioned in the path of air entering the chamber.

13. An inspiratory muscle training device according to claim 3, wherein means is provided to vary the rate at which the pressure differential required to open the valve changes.

14. An inspiratory muscle training device according to claim 15, wherein means is provided for varying the proportion of air flowing through the further valve relative to the volume of air flowing through the first-mentioned valve so as to vary the rate at which the pressure differential changes.

15. An inspiratory muscle training device according to claim 13, wherein the valve is mechanically linked to a further valve which passes air at a flow rate proportional to the flow rate of air through the first-mentioned valve.

* * * * *